US006028533A

United States Patent [19]

Javors

[11] Patent Number: 6,028,533

[45] Date of Patent: Feb. 22, 2000

[54] TOY WITH REMOTELY CONTROLLED SECURITY ALARM

[75] Inventor: Russell Javors, Massepequa, N.Y.

[73] Assignee: Toymax Inc., Plainview, N.Y.

[21] Appl. No.: 08/892,374

[22] Filed: Jul. 14, 1997

[51] Int. Cl.[7] ..... A63H 5/00

[52] U.S. Cl. ..... 340/825.72; 340/825.69; 273/442; 446/175; 446/454; 446/455; 446/456; 446/457; 446/465

[58] Field of Search ..... 340/825.69, 825.72; 273/442; 446/409, 175, 454–7, 465

[56] References Cited

U.S. PATENT DOCUMENTS

| | | | |
|---|---|---|---|
| 4,219,962 | 9/1980 | Dankman et al. | 46/232 |
| 4,242,107 | 12/1980 | Jenkins | 55/18 |
| 4,325,199 | 4/1982 | McEdwards | 46/232 |
| 4,580,994 | 4/1986 | Fauser et al. | 446/465 |
| 4,817,948 | 4/1989 | Simonelli | 273/86 B |
| 4,925,427 | 5/1990 | Wu | 446/406 |
| 4,946,416 | 8/1990 | Stern et al. | 446/409 |
| 4,964,837 | 10/1990 | Collier | 446/409 |
| 5,024,626 | 6/1991 | Robbins et al. | 446/409 |
| 5,045,016 | 9/1991 | Stern et al. | 446/409 |
| 5,195,920 | 3/1993 | Collier | 446/409 |
| 5,306,197 | 4/1994 | Watanabe | 446/409 |

*Primary Examiner*—William A. Cuchlinski, Jr.
*Assistant Examiner*—Yonel Beaulieu
*Attorney, Agent, or Firm*—Cowan, Liebowitz & Latman, P.C.

[57] ABSTRACT

A security alarm device is replicated in a toy vehicle. The security device includes a remote control which also can control vehicle functions. The remote control may control alarm arm and disarm, alarm and vehicle sounds such as arm, disarm, alarm set off, engine revving, tire screeching, motor drive, and vehicle lights. The security alarm device includes an LED which indicates whether the alarm is armed or unarmed, and a motion sensor which sets the alarm off (e.g., emitting a siren sound) when the toy vehicle is moved in its armed state.

28 Claims, 3 Drawing Sheets

TOY WITH REMOTELY CONTROLLED SECURITY ALARM

BACKGROUND OF THE INVENTION

The invention disclosed herein relates to a toy, such as a toy vehicle, which has a remotely controlled security alarm.

Toy designers seek to provide toys which replicate real life because realistic toys have high play value, and typically, the more realistic the toy, the greater its play value. Among the many toys for which this is evident are toy vehicles. Realism in toy vehicles has been achieved in appearance, sound and function. For example, miniature toy vehicles are sold which seek to replicate in appearance the full scale real life versions down to minute details. Some reduced scale toy vehicles even have functioning parts, such as doors that open, etc. Other reduced scale toys, somewhat larger than miniatures, provide more elaborate functioning parts and/or provide sound effects, while retaining much if not all of the detail of the miniatures. Still other toy vehicles provide functionality and/or sound effects by remote control. See, for example, the following U.S. Pat. Nos. 4,219,962; 4,242,107; 4,325,199; 4,580,994; 4,817,948; 4,946,416; 4,964,837; 5,024,626; 5,045,016; 5,195,920; and 5,306,197.

OBJECTS AND SUMMARY OF THE INVENTION

It is an object of the invention disclosed herein to replicate some or all vehicle security alarm functions in a toy vehicle.

It is another object of the invention to provide a security alarm device in a toy vehicle.

It is another object of the invention to provide a security alarm device in a toy vehicle which is remotely controlled.

The invention achieves this and other objects by replicating one or more vehicle alarm functions in a toy vehicle.

A toy vehicle which incorporates a security alarm device in accordance with the invention comprises a controller having a control input, at least one sensor. coupled to the controller, and a signaling device coupled to the controller. The security alarm device has an armed state and an unarmed state and is responsive to the at least one sensor in its armed state and to the control signal input to assume the armed and unarmed states. The controller causes the signaling device to generate a signal in response to activation of the at least one sensor in the armed state of the security alarm device and cause the signaling device to cease generating the signal when the alarm device is placed in its unarmed state.

In another embodiment, a toy vehicle incorporates a security alarm device in accordance with the invention comprising the controller and signalling device described above, but does not necessarily include the sensor. In this embodiment, the controller causes the signaling device to a generate a signal in response to a change in state of the security alarm device between its armed state and its unarmed state.

In the preferred embodiment, the security device includes the sensor and the controller causes the signaling device to generate a signal in response to a change in state of the security alarm device between its armed state and its unarmed state.

In the preferred embodiment, the signaling device comprises an audio device which generates a sound signal, but may instead comprise a visual device which generates a visual signal, or both.

The toy vehicle may comprise a propulsion system including an electric motor which propels the toy vehicle and a motor drive which selectively supplies power to the electric motor, and the controller is coupled to the motor drive and disables the motor drive when the alarm device is in its armed state.

In the preferred embodiment, the security alarm device and all or selected other vehicle functions are controlled remotely by a remote control device coupled to the control input of the controller. Preferably, the remote control device and the security alarm device are wirelessly coupled, and the toy vehicle comprises a receiver coupled to the control input of the security alarm device controller operative to wirelessly receive a signal from the remote control device. The controller is responsive to the receiver to cause the security alarm device to assume its armed and unarmed states.

The sensor may be a motion sensor or a microswitch or magnetic switch, for example.

The remote control device may include an infrared transmitter and the receiver correspondingly includes an infrared receiver.

In the preferred embodiment, the controller includes a sound synthesizer and the signaling device comprises a speaker coupled to the controller to receive sound signals therefrom. The synthesizer generates beep sound signals representing changes of state of the security alarm device between its armed and unarmed states and a siren sound or a honking horn signal, and the controller causes the synthesizer to generate the beep signals in response to a change in state of the security alarm device between its armed state and its unarmed state and the siren or honking horn sound in response to activation of the at least one sensor in the armed state of the security alarm device.

The signalling device may be a visual device such as the vehicle lights, or the signalling device can include audio and visual devices. The audio and visual devices may be lights and a horn which are typically provided with a vehicle, or audio and visual devices which form part only of the alarm device.

BRIEF DESCRIPTION OF THE DRAWINGS

The invention is illustrated in the figures of the accompanying drawings which are meant to be exemplary and not limiting, in which like numerals in the different figures refer to like or corresponding parts, and in which.

DESCRIPTION OF THE PREFERRED EMBODIMENTS

Figure 1:
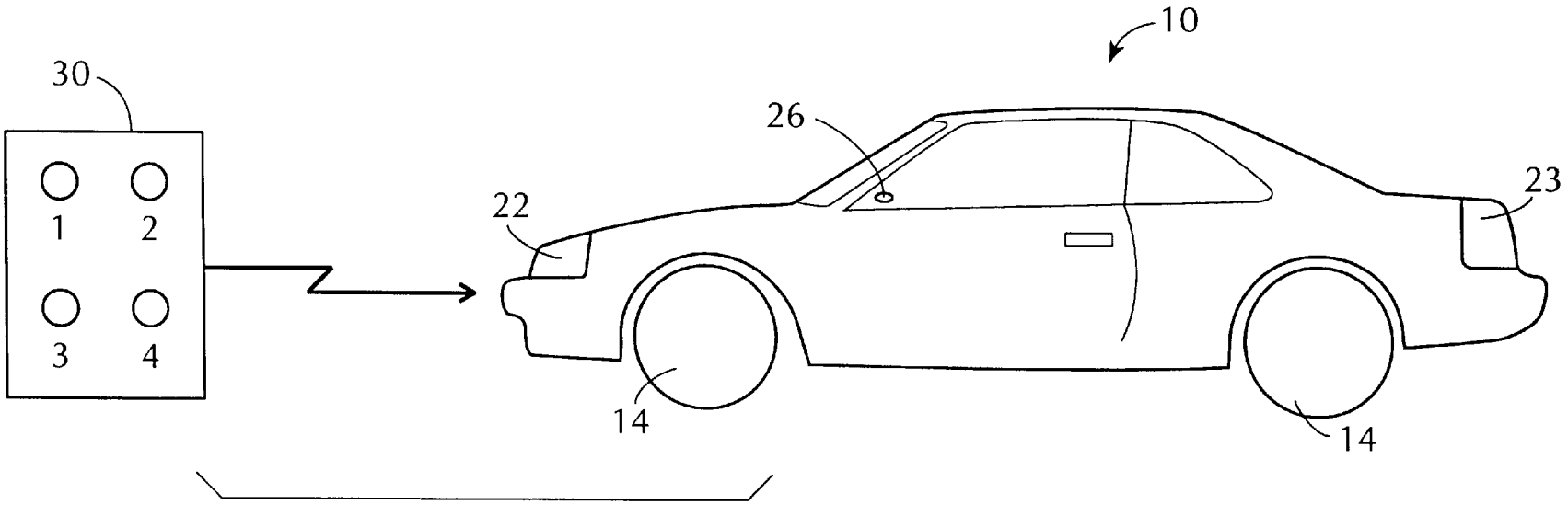
FIG. 1 shows a toy vehicle and a remote control incorporating a security alarm device in accordance with the invention.
Figure 2:
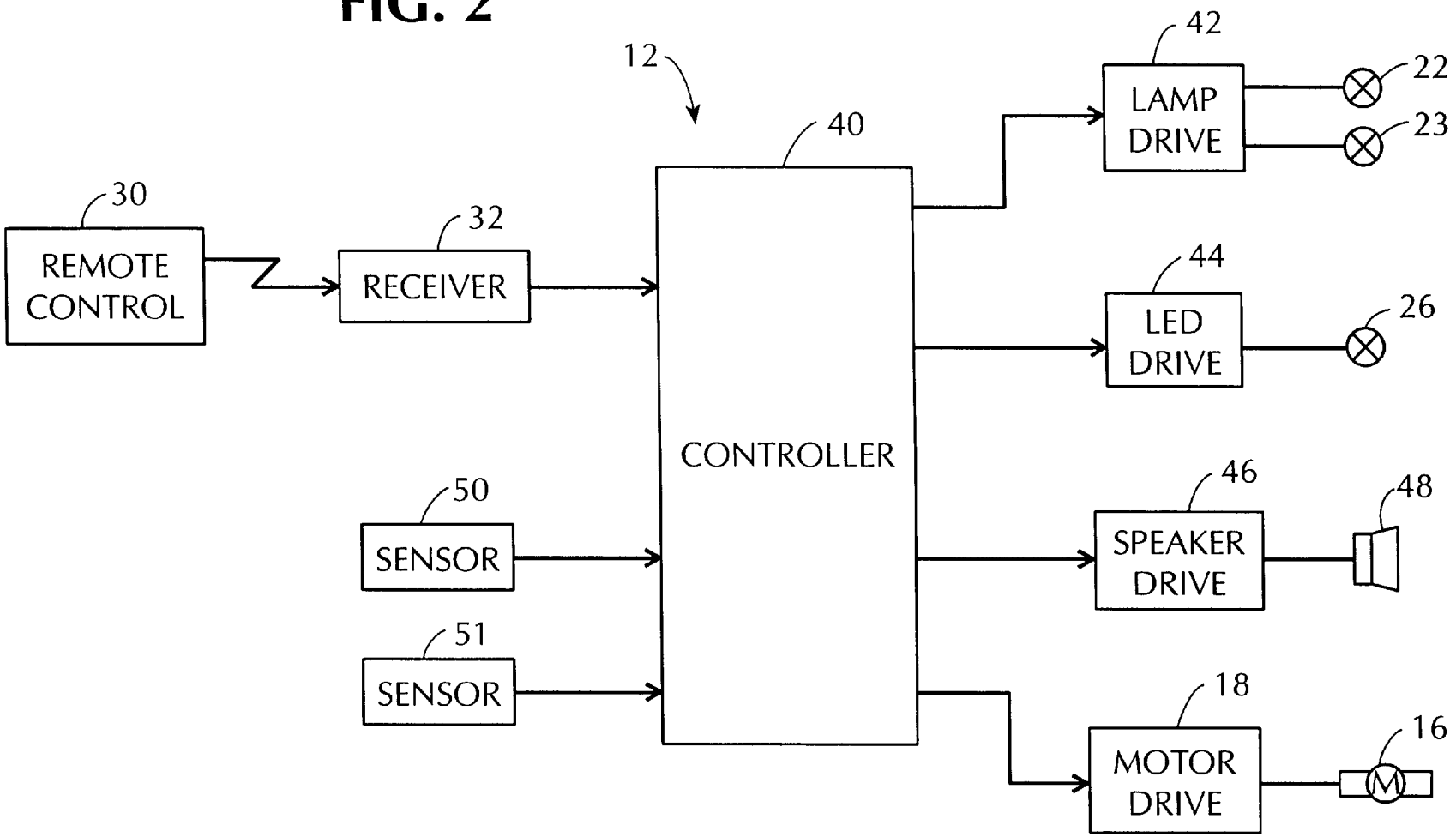
FIG. 2 is a block diagram of the security alarm device, the vehicle head lights and tail lights and the vehicle motor.

Referring to FIG. 1, a toy vehicle 10 includes the security alarm device 12 represented in FIG. 2. The vehicle 10 includes wheels 14 at least one of which is driven by a motor 16 (FIG. 2) in conventional fashion except for interaction between the alarm device 12 and the motor 16 (via the motor drive 18). The vehicle 10 may include head lights and tail lights 22 and 23, which may also be conventional except for any interaction with the alarm device 12. The alarm device 12 may include an indicator 26 (e.g., a lamp or a light-emitting diode "LED") which indicates whether the alarm device 12 is in an armed state or an unarmed state.

In the preferred embodiment, the alarm device 12 includes a remote control 30 and a receiver 32 (FIG. 2) carried by the vehicle 10 which are wirelessly coupled together. In the preferred embodiment, the remote control 30 includes an infrared transmitter and the receiver 32 is an infrared receiver. However, the remote control 30 may be connected to the toy vehicle by one or more conductors, in which case the receiver 32 may be omitted. Also, the remote control 30 may include a transmitter other than an IR transmitter. e.g., a radio transmitter or an ultrasonic sound transmitter, etc., and the receiver 32 will be compatible with the transmitter.

Referring to FIG. 1, the remote control 30 may control the following alarm and vehicle functions:

alarm arm and disarm (push button switch #1);

engine revving sound (push button switch #2);

motor drive (push button switch #3); and vehicle lights (push button switch #4).

Referring to FIG. 2, the remote control 30 transmits coded signals to the receiver 32 carried by the vehicle, which detects the transmitted signals and supplies the detected signals to a controller 40. The controller 40 decodes the signals supplied by the receiver 32 and selectively activates the lamp drive 42 which drives the vehicle head lights 22 and the vehicle tail lights 23, the lamp drive 44 which drives the alarm indicator 26, the speaker drive 46 which drives the speaker 48 and the motor drive 18 which drives the motor 16. One or more sensors 50, 51 are coupled to the controller 40 to provide signals representing security violations. In the preferred embodiment, sensor 50 is a motion sensor. Additional sensors such as sensor 51 may be microswitches or magnetic switches which provide a signal to the controller 40 when the switch is activated and/or deactivated representing, for example, opening and closing a door or hood or trunk lid.

The controller 40 is preferably a programmed computer which includes a sound synthesizer, and is programmed to carry out the functions described herein and generate sound signals representing the sounds described herein in response to input signals from the receiver 32 and the sensors 50, 51. Alternatively, a separate sound synthesizer may be provided.

Figure 3:
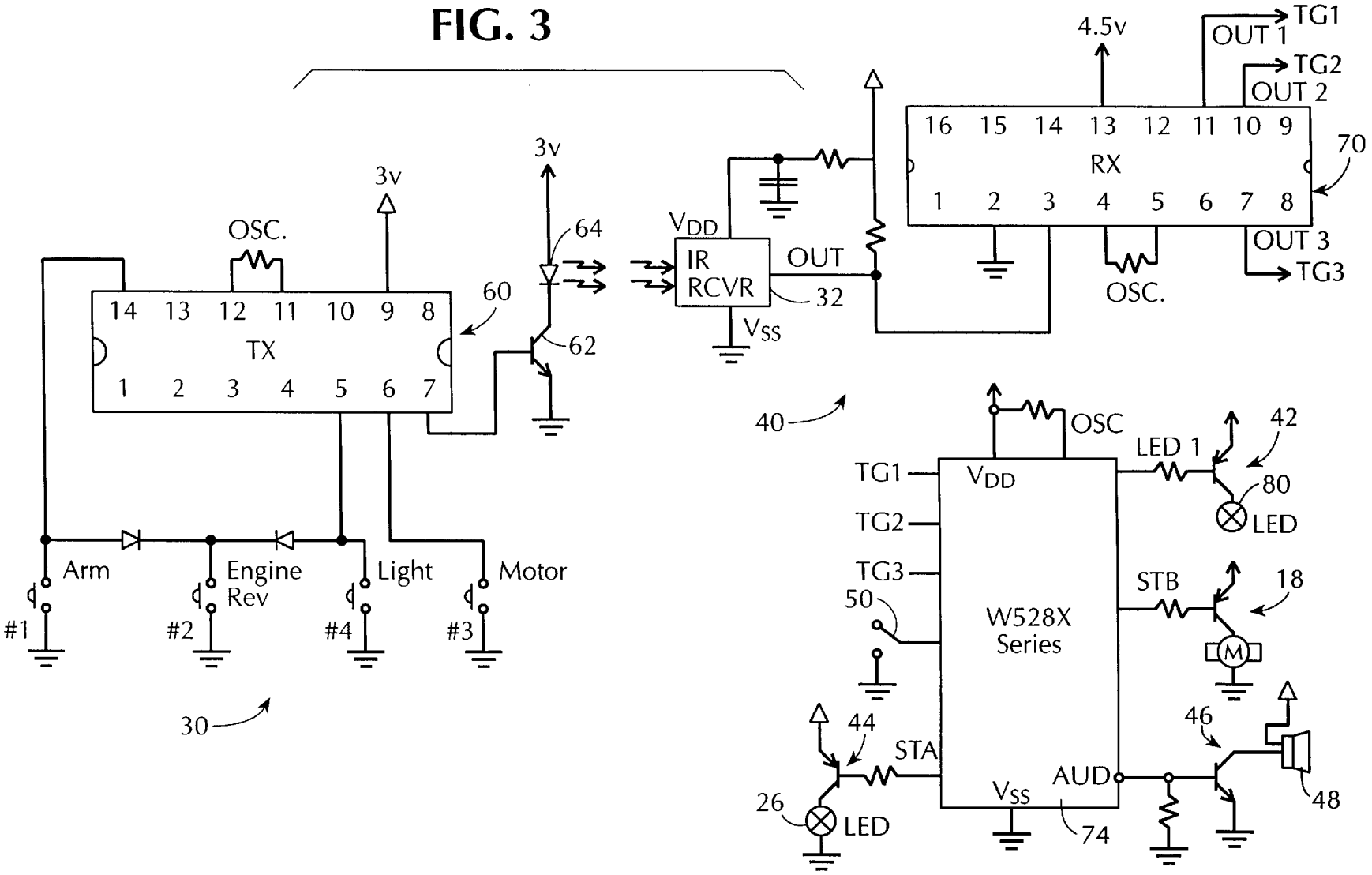
FIG. 3 is a circuit schematic diagram of an implementation of the block diagram of FIG. 2

FIG. 3 shows an implementation of the block diagram of FIG. 2. In the remote control 30, the push button switches ##1, 2, 3 and 4 are coupled to a modulator 60, which modulates the drive to transistor 62 differently in response to activation of each of switches ##1, 2, 3 and 4, and thereby modulates the current to the IR emitter 64. The IR emitter 64 emits modulated IR light in accordance with the different current modulation patterns provided by the modulator 60. The modulator 60 may be any conventional modulator and the IR emitter 64 may be any conventional IR emitter such as an IR LED.

In the vehicle 10, an IR receiver 32 detects the modulated IR light emitted by the IR emitter 64 and supplies the detected signal to a demodulator 70, which demodulates and decodes the received signal and provides an output signal on the appropriate output Out 1, Out 2 or Out 3 depending upon the modulated signal received by the IR receiver 32. The outputs Out 1–3 of demodulator 70 are coupled to trigger inputs TG 1–3 of a controller circuit 74. The motion sensor 50 is coupled to a fourth input of the controller circuit 74. An LED alarm indicator 26 is coupled to the STA output of the controller circuit 74, and when lit indicates that the alarm is armed. In the embodiment of FIG. 3, the LED 80 replaces the separate head lights 22 and tail lights 23 of FIG. 2.

The IR receiver 32, the demodulator 70 and the controller circuit 74 may be conventional. In the preferred embodiment, the controller circuit 74 is a Series W528x integrated circuit available from Windbond Electronics Corp. (Republic of China), and includes an ADPCM (adaptive differential pulse-code modulation) voice synthesizer. The controller circuit 74 includes a programmed processor, which may be programmed by one of skill in the art to carry out the functions described herein.

While the invention has been described and illustrated in connection with preferred embodiments, many variations and modifications, as will be apparent to those of skill in the art, may be made without departing from the spirit and scope of the invention. The invention as set forth in the appended clams is thus not limited to the precise details of construction set forth above as such variations and modifications are intended to be included within the spirit and scope of the invention as set forth in the defined claims.

I claim:

1. A vehicular toy comprising:

a security alarm device comprising a controller having a control input and at least one sensor coupled to the controller, the security alarm device having an armed state and an unarmed state and being responsive to the at least one sensor in its armed state and to the control signal input to selectively assume the armed and unarmed states;

a signaling device coupled to the controller and responsive thereto to provide an audio or visual alarm signal;

the controller causing the signaling device to provide the alarm signal in response to activation of the at least one sensor in the armed state of the security alarm device and causing the signaling device to cease providing the alarm signal when the alarm device assumes its unarmed state.

2. The toy of claim 1 wherein the signaling device comprises an audio device coupled to the controller which projects sound as the audio alarm signal.

3. The toy of claim 1 wherein the signaling device comprises a visual device coupled to the controller which projects light as the visual alarm signal.

4. The toy of claim 1 comprising a propulsion system including an electric motor which propels the toy and a motor drive which selectively supplies power to the electric motor, the controller being coupled to the motor drive and selectively supplying drive signals thereto at least in response to signals at the control input thereof.

5. The toy of claim 1 comprising a remote control device coupled to the controller, the controller being operative to cause the alarm device to assume its armed and unarmed states in response to the remote control device.

6. The toy of claim 5 wherein the toy comprises a receiver wirelessly coupled to the remote control device, the receiver being coupled to the control input of the controller and being operative to wirelessly receive signals from the remote control device and provide signals in response thereto to the control input of the controller, the controller being responsive to the signals at the control input to cause the security alarm device to assume its armed and unarmed states.

7. The toy of claim 6 wherein the remote control device includes an infrared transmitter and the receiver includes an infrared receiver.

8. The toy of claim 1 comprising a remote control device and a receiver wirelessly coupled to the remote control device and coupled to the control input of the controller, and a propulsion system including an electric motor which propels the toy, the electric motor being coupled to and controlled by the controller, the controller being operative in response to signals provided by the receiver to the control input to cause the alarm device to assume its armed and unarmed states and to provide drive signals to the motor, the receiver providing signals to the control input in response to signals wirelessly received from the remote control device.

9. The toy of claim 1 wherein the controller provides arm/unarm signals to the signaling device representing changes of state of the security alarm device between its armed and unarmed states and an alarm signal to the signaling device in response to activation of the at least one sensor in the armed state of the security alarm device, the signaling device providing arm/unarm and alarm audio or visual signals in response thereto.

10. The toy of claim 9 comprising a receiver coupled to the control input of the controller and a remote control wirelessly coupled to the receiver, and wherein the remote control device comprises a first control which when activated causes the remote control device to wirelessly transmit signals in response to which the security alarm device assumes its armed and unarmed states and the signaling device provides arm/unarm audio signals, and a second control which when activated causes the remote control device to wirelessly transmit signals in response to which the controller causes the signaling device to provide audio being at least one of an engine revving or tire screeching sound.

11. The toy of claim 1 wherein the sensor comprises a motion sensor.

12. A vehicular toy comprising:

a security alarm device comprising a controller having a control input and at least one sensor coupled to the controller, the security alarm device having an armed state and an unarmed state and being responsive to the at least one sensor in its armed state and to the control signal input to selectively assume the armed and unarmed states;

an audio device coupled to the controller responsive thereto to provide an alarm sound;

the controller causing the audio device to provide the alarm sound in response to activation of the at least one sensor in the armed state of the security alarm device and causing the audio device to cease providing the alarm sound when the alarm device assumes its unarmed state, the controller further causing the audio device to provide arm and unarm sounds when the state of the alarm device changes from armed to unarmed and from unarmed to armed.

13. The toy of claim 12 comprising a propulsion system including an electric motor which propels the toy and a motor drive which selectively supplies power to the electric motor, the controller being coupled to the motor drive and selectively supplying drive signals thereto at least in response to signals at the control input thereof.

14. The toy of claim 12 or 1 comprising a remote control device coupled to the controller, the controller being operative to cause the alarm device to assume its armed and unarmed states in response to the remote control device.

15. The toy of claim 14 wherein the toy comprises a receiver wirelessly coupled to the remote control device, the receiver being coupled to the control input of the controller and being operative to wirelessly receive a signal from the remote control device and provide signals in response thereto to the control input of the controller, the controller being responsive to the signals at the control input to cause the security alarm device to assume its armed and unarmed states.

16. The toy of claim 15 wherein the remote control device includes an infrared transmitter and the receiver includes an infrared receiver.

17. The toy of claim 12 comprising a remote control device and a receiver wirelessly coupled to the remote control device and coupled to the control input of the controller, and a propulsion system including an electric motor which propels the toy, the electric motor being coupled to and controlled by the controller, the controller being operative in response to signals provided by the receiver to the control input to cause the alarm device to assume its armed and unarmed states and to provide drive signals to the motor, the receiver providing signals to the control input in response to signals wirelessly received from the remote control device.

18. The toy of claim 12 wherein the controller provides arm/unarm signals to the signaling device representing changes of state of the security alarm device between its armed and unarmed states and an alarm signal to the signaling device in response to activation of the at least one sensor in the armed state of the security alarm device, the signaling device providing arm/unarm and alarm audio or visual signals in response thereto.

19. The toy of claim 18 comprising a receiver coupled to the control input of the controller and a remote control wirelessly coupled to the receiver, and wherein the remote control device comprises a first control which when activated causes the remote control device to wirelessly transmit signals in response to which the security alarm device assumes its armed and unarmed states and the signaling device provides arm/unarm audio signals, and a second control which when activated causes the remote control device to transmit signals in response to which the controller causes the signaling device to provide audio being at least on of an engine revving or tire screeching sound.

20. The toy of claim 12 wherein the sensor comprises a motion sensor.

21. A toy comprising:

a security alarm device comprising a controller having a control input and at least one sensor coupled to the controller, the security alarm device having an armed state and an unarmed state and being responsive to the at least one sensor in its armed state and to the control signal input to selectively assume the armed and unarmed states;

a signaling device coupled to the controller and responsive thereto to provide an audio or visual alarm signal;

the controller causing the signaling device to provide the alarm signal in response to activation of the at least one sensor in the armed state of the security alarm device and causing the signaling device to cease providing the alarm signal when the alarm device assumes its unarmed state.

22. A toy comprising:

a security alarm device comprising a controller having a control input and at least one sensor coupled to the controller, the security alarm device having an armed state and an unarmed state and being responsive to the at least one sensor in its armed state and to the control signal input to selectively assume the armed and unarmed states;

an audio device coupled to the controller responsive thereto to provide an alarm sound;

the controller causing the audio device to provide the alarm sound in response to activation of the at least one sensor in the armed state of the security alarm device and causing the audio device to cease providing the alarm sound when the alarm device assumes its unarmed state, the controller further causing the audio device to provide arm and unarm sounds when the state of the alarm device changes from armed to unarmed and from unarmed to armed.

23. A toy comprising:

a security alarm device comprising a controller having a control input and at least one sensor coupled to the controller, the security alarm device having an armed state and an unarmed state and being responsive to the at least one sensor in its armed state, the controller causing the security alarm device to selectively assume the armed and unarmed states in response to signals at the control input;

a wireless remote control device coupled to the controller which in response to signals from the remote control device causes the alarm device to assume its armed and unarmed states a signaling device coupled to the controller and responsive thereto to provide an audio or visual alarm signal;

the controller causing the signaling device to provide the alarm signal in response to activation of the at least one sensor in the armed state of the security alarm device and causing the signaling device to cease providing the alarm signal when the alarm device is caused to assume its unarmed state.

24. The toy of claim 23 wherein the toy comprises a receiver wirelessly coupled to the remote control device, the receiver being coupled to the control input of the controller and being operative to wirelessly receive a signal from the remote control device and provide signals in response thereto to the control input of the controller, the controller being responsive to the signals at the control input to cause the security alarm device to assume its armed and unarmed states.

25. The toy of claim 24 wherein the controller provides arm/unarm signals to the signaling device representing changes of state of the security alarm device between its armed and unarmed states and an alarm signal in response to activation of the at least one sensor in the armed state of the security alarm device, the signaling device providing arm/unarm and alarm audio or visual signals in response thereto.

26. A toy comprising:

a security alarm device comprising a controller having a control input and at least one sensor coupled to the controller, the security alarm device having an armed state and an unarmed state and being responsive to the at least one sensor in its armed state, the controller causing the security alarm device to selectively assume the armed and unarmed states in response to signals at the control input;

a wireless remote control device coupled to control input of the controller which in response to signals from the remote control device causes the alarm device to assume its armed and unarmed states an audio device coupled to the controller responsive thereto to provide an alarm sound;

the controller causing the audio device to the alarm sound in response to activation of the at least one sensor in the armed state of the security alarm device and causing the audio device to cease providing the alarm sound when the alarm device is caused to assume its unarmed state, the controller further causing the audio device to provide arm and unarm sounds when the state of alarm device changes from armed to unarmed and from unarmed to armed.

27. The toy of claim 26 wherein the toy comprises a receiver wirelessly coupled to the remote control device, the receiver being coupled to the control input of the controller and being operative to wirelessly receive a signal from the remote control device and provide signals in response thereto to the control input of the controller, the controller being responsive to the signals at the control input to cause the security alarm device to assume its armed and unarmed states.

28. The toy of claim 27 wherein the controller provides arm/unarm signals to the audio device representing changes of state of the security alarm device between its armed and unarmed states and an alarm signal in response to activation of the at least one sensor in the armed state of the security alarm device, the audio device providing arm/unarm and alarm sounds in response thereto.

* * * * *